US006511256B1

(12) United States Patent
Flader et al.

(10) Patent No.: US 6,511,256 B1
(45) Date of Patent: Jan. 28, 2003

(54) PAVEMENT MARKER WITH IMPROVED DAYTIME VISIBILITY AND FLUORESCENT DURABILITY

(75) Inventors: Michael E. Flader, Chicago, IL (US); Dennis I. Couzin, Evanston, IL (US); Robert M. Pricone, Libertyville, IL (US); Guang-Xue Wei, Northbrook, IL (US); Drew J. Buoni, Chicago, IL (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 09/709,921

(22) Filed: Nov. 10, 2000

Related U.S. Application Data

(63) Continuation-in-part of application No. 09/580,238, filed on May 26, 2000.
(60) Provisional application No. 60/136,165, filed on May 27, 1999.

(51) Int. Cl.[7] ..... G02B 5/12; E01F 9/08
(52) U.S. Cl. ..... 404/13; 404/12; 404/14; 359/551
(58) Field of Search ..... 359/531, 551; 404/9, 12, 13, 14, 16; D10/113

(56) References Cited

U.S. PATENT DOCUMENTS

| | | | | | |
|---|---|---|---|---|---|
| 3,332,327 | A | * | 7/1967 | Heenan | 359/531 |
| 3,879,148 | A | * | 4/1975 | Eigenmann | 359/536 |
| 3,890,054 | A | * | 6/1975 | O'Connor | 404/10 |
| 3,908,055 | A | * | 9/1975 | Susuki et al. | 404/12 |
| 4,040,760 | A | | 8/1977 | Wyckoff | |
| 4,303,305 | A | * | 12/1981 | Jones | 359/533 |
| 4,924,152 | A | * | 5/1990 | Flickinger | 315/363 |
| 5,013,181 | A | * | 5/1991 | Harrison | 404/12 |
| 5,078,538 | A | * | 1/1992 | Montalbano | 404/12 |
| 5,226,745 | A | | 7/1993 | Gartlacher | |
| 5,258,485 | A | | 11/1993 | Matsuo et al. | |
| 5,393,166 | A | | 2/1995 | Stock et al. | |
| 5,412,381 | A | * | 5/1995 | Dicks | 340/332 |
| 5,816,737 | A | | 10/1998 | Siblik | |
| 6,110,566 | A | | 8/2000 | White et al. | |
| 6,126,360 | A | * | 10/2000 | May et al. | 404/14 |

FOREIGN PATENT DOCUMENTS

| | | |
|---|---|---|
| DE | 2361264 | 6/1975 |
| GB | 2139674 | 11/1984 |

* cited by examiner

*Primary Examiner*—Gary S. Hartmann
(74) *Attorney, Agent, or Firm*—Jones, Day, Reavis & Pogue

(57) ABSTRACT

A pavement marker having improved daytime visibility comprises a transparent fluorescent top portion having a top surface and a front edge. Light received by the top surface of the top portion results in light being directed internally through the top portion and emitted from the front edge, thereby providing a daytime signal to drivers of oncoming vehicles. In an alternative embodiment, the top portion can comprise a polymer having in its backbone moieties that either absorb U.V. light or that are capable of undergoing rearrangement to moieties that absorb U.V. light, to provide greater fluorescent durability. The polymer can be present either within the fluorescent top portion or as a U.V. light screening layer on top of the top portion.

45 Claims, 2 Drawing Sheets

PAVEMENT MARKER WITH IMPROVED DAYTIME VISIBILITY AND FLUORESCENT DURABILITY

RELATED APPLICATION

This application is a continuation-in-part of application Ser. No. 09/580,238 filed May 26, 2000, which claims the benefit of U.S. Provisional Application Ser. No. 60/136,165, filed May 27, 1999.

FIELD OF THE INVENTION

This invention relates to a pavement marker intended to be mounted to a roadway surface and having improved visibility in daytime, as well as providing a visible signal at night.

BACKGROUND OF THE INVENTION

Pavement markers have become widely accepted as means for providing visible signals which mark traffic lanes and control the flow of traffic on roadways in combination with, or in place of, conventional painted traffic lines. A large number of such markers employ retroreflectors which retroreflect light emanating from oncoming vehicles to provide a signal visible to the operators of such oncoming vehicles, especially at night.

Typically, pavement markers comprise a base member designed to be firmly secured to the associated roadway surface; and a retroreflective signal means mounted on or formed as part of the base member. As disclosed in basic U.S. Pat. No. 3,332,327, assigned to the assignee herein, the disclosure of which is incorporated herein by reference, the base member can be a molded plastic housing having cube corner elements. Some pavement markers are intended to be permanently installed on a roadway surface. These include those markers sold by the assignee herein under the model names Stimsonite Model 948, and Stimsonite Model 953. Pavement markers also can be used to delineate roadway construction work zones. Such markers include those sold by the assignee herein under the model name Stimsonite Model 66, intended for temporary installations at construction work zones. The Stimsonite Model 88 sun country marker also can be used for more permanent installations at construction work zones. Pavement markers of the prior art are also disclosed in U.S. Pat. Nos. 5,078,538 and 5,403,115, both assigned to the assignee herein and both being incorporated herein by reference. Other pavement markers of other manufacturers are also available.

In such markers of the prior art, the plastic housing of the pavement marker is typically an opaque color suitable for the intended use of the marker. For example, a marker intended to be placed on or in place of a white dividing lane may be a white plastic, a marker intended to be placed on or in place of a yellow dividing line may be yellow plastic, and a marker intended for temporary placement in a roadway construction work zone may be yellow or white.

While such markers are intended to provide enhanced nighttime visibility by retroreflecting light from vehicle headlights back to the vehicle drivers, it also would be desirable if the markers could provide enhanced daytime visibility. The upper and side surfaces of a raised pavement marker are not readily visible to a driver of an oncoming vehicle, because these surfaces are at an angle highly oblique to the driver's viewing direction. Daytime visibility therefore must be provided primarily by the front surface of the marker, which is easily seen by the driver. The major portion of the marker front surface, however, is occupied by the retroreflector, which for optical reasons appears almost black in daytime. It would be desirable to provide a roadway marker mounted on a roadway surface that provides greater daytime visibility than those markers currently available or described in the prior art. In particular, it would be desirable to provide pavement markers having enhanced daytime visibility and adapted either for use in roadway construction work zones or as permanent sun country markers.

SUMMARY OF THE INVENTION

In accordance with the invention, a pavement marker comprises a base member having a top portion and a bottom portion, which top and bottom portions can be formed either as an integral base member or as two separate parts secured together to form a base member. The bottom portion has a bottom surface adapted to be secured to the pavement surface, and the top portion has a top surface, and at least one edge surface. If the top portion and bottom portion are formed as two separate parts, then the top portion has a bottom surface that can be secured to the bottom portion of the base member, and the at least one edge surface of the top portion is between the top surface and the bottom surface of the top portion. At least the top portion of the base member is made of a transparent fluorescent resin material. It has been found that light received by the top surface of the top portion of the base member results in light being directed internally through the fluorescent resin material and emitted from the edge surface of the top portion, thereby providing a surprisingly bright daytime signal to drivers of oncoming vehicles. It is preferred that the top surface and the bottom surface of the top portion are each smooth, flat, and parallel to each other. It is further preferred that the top portion be secured to the bottom portion of the base member such that there is an air gap between at least part of the top portion and at least part of the bottom portion of the base member. Optionally, the bottom portion of the base member can also be a transparent fluorescent material, or it can be an opaque color of any choice. In a preferred embodiment, the pavement marker will also include a retroreflector mounted on the base member to provide nighttime visibility to drivers of oncoming vehicles. When the inventive marker is to be used in a roadway construction work zone environment, it is preferred that the fluorescent resin material of the marker be of a transparent fluorescent orange, such as is commonly used in road signs to denote a construction work zone.

BRIEF DESCRIPTION OF THE DRAWINGS

The present invention will be more fully understood in conjunction with the accompanying drawings.

DETAILED DESCRIPTION OF A PREFERRED EMBODIMENT

Figure 1:
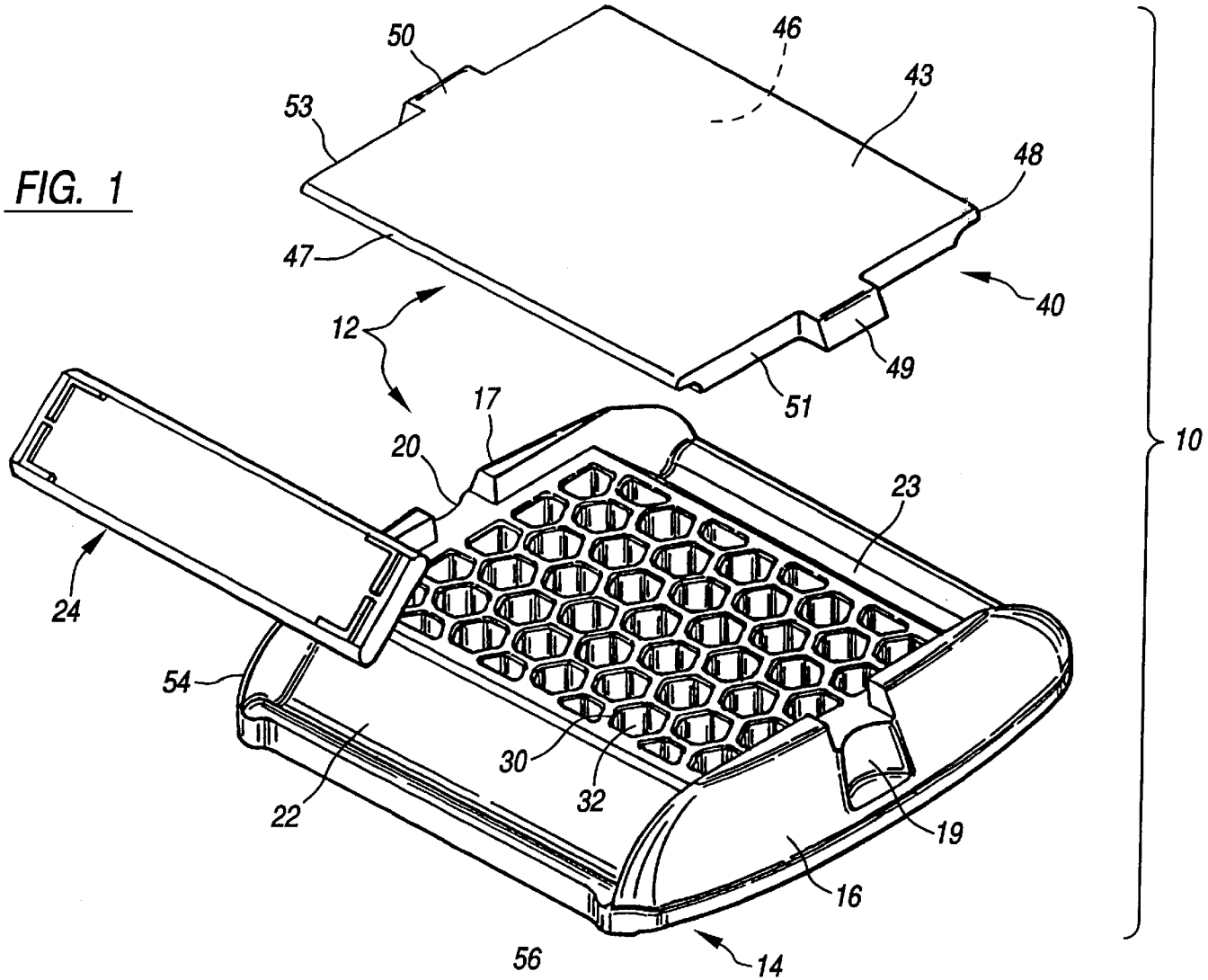
FIG. 1 is an exploded view of an embodiment of the pavement marker of the instant invention.

Referring to FIG. 1, pavement marker 10 comprises a base member 12, the base member comprising a bottom portion 14 and a top portion 40. Bottom portion 14 has longitudinal side walls 16, 17, each of which is provided with optional depression 19, 20. Bottom portion 14 further includes a front surface 22 adapted to receive thereon a signal means 24, such as a cube corner retroreflector (cube corner elements not shown). It will be appreciated that if the marker is to be viewable from vehicles traveling in opposite directions, then there will be another signal means in another surface 23 disposed longitudinally opposite front surface 22. Bottom portion 14 further comprises a top surface preferably flat and having a plurality of orifices 32 disposed therein. In the illustrated embodiment the orifices are hexagonal and disposed in a "honeycomb" pattern, although the invention herein is not intended to be limited to the illustrated embodiment. Bottom portion 16 of base member 12 also comprises a bottom surface, not shown, adapted to be adhered to a roadway surface, such as by means of an appropriate adhesive.

Top portion 40 of base member 12 comprises a top surface 43, a bottom surface 46, and a front edge surface 47 disposed between said top surface 43 and said bottom surface 46. Optional transversely projecting tabs 49, 50 are sized and positioned on top portion 40 to extend over depressions 19, 20 when the bottom portion 14 and top portion 40 are assembled together. Top portion 40 is made of a transparent fluorescent resin material. Preferably, top surface 43 and bottom surface 46 are each smooth, flat, and substantially parallel to one another.

Top portion 40 is assembled to bottom portion 14 by a means such as welding, the welding being in a predetermined location or pattern. Preferably, the welding pattern will provide an air gap between as much of bottom surface 46 of top portion 40 and top surface 30 of bottom portion 14 as possible, while still retaining top portion 40 securely on bottom portion 14; tack welds or line welds can be adequate for this purpose. It will be seen that the orifices 32 provide the surface area of bottom surface 46 that will be in contact with air.

In such a configuration, the top portion 40 exhibits the phenomenon known as "edge glow." Light entering top surface 43 of transparent top portion 40 containing fluorescent colorants excites fluorescent emission within the volume of the top portion 40. As understood in the optical arts, for the boundary separating two optical media, "critical angle" is defined as the smallest angle of incidence in the medium of greater refractive index for which light is totally reflected, or, alternatively, the greatest angle of incidence for which light escapes the medium. Fluorescent emission is spherical. Within the sphere is a double cone of rays that meet top and bottom surfaces 43 and 46 of transparent top portion 40 at incidence angles less than the critical angle $\theta_c$. The fraction of the spherical volume outside this double cone is $\cos\theta_c$, representing the fraction of the fluorescence which total internal reflection (TIR) prevents from escaping from surfaces 43 and 46 of top portion 40. TIR is the ideal dielectric face reflectivity that can occur at the interface between a transparent material and air, whereby light traveling within the material and encountering the interface is internally reflected and so remains in the material.

The fraction of emitted light outside the double cone which experiences TIR is $\cos\theta_c$, which for a particular material can be determined as $$\cos\theta_c = \frac{\sqrt{n^2 - 1}}{n}$$

where n is the index of refraction of the material. For example, acrylic has an index of refraction of 1.49, its critical angle is calculated as $\theta_c$=42.16°, and $\cos\theta_c$=0.74. In other words, for a top portion 40 made of an acrylic material, 74% of the emitted fluorescent light will experience TIR at the solid/air interfaces at smooth flat surfaces 43 and 46, and will be returned from those interfaces back into top portion 40.

The fluorescent light induced in top portion 40 will continue to reflect and re-reflect by TIR until it reaches an edge surface; i.e., top portion 40 functions as a light pipe to direct fluorescent emissions induced within the volume of top portion 40 by light incident on top surface 43 thereof toward the edge surfaces, including edge surface 47. This phenomenon is enhanced when top portion 40 is configured as a flat plate with smooth parallel faces. In such a preferred embodiment, assuming that edge surface 47 is substantially perpendicular to smooth flat surfaces 43, 46, the angle of incidence of light at the edge will be less than $90-\theta_c$ for most of the previously trapped light. As the surface area of top surface 43 is increased, more light will be received, more fluorescent emissions will be induced, and more light will be directed to the edge surfaces, including edge surface 47. Light emitted through edge surface 47 provides a brighter daytime signal to the driver of an oncoming vehicle as compared to opaque pavement markers of the prior art.

The enhanced brightness of the front edge of markers of the instant invention can be understood as follows: A prior art marker having a diffusely reflective top portion with horizontal surface area A and reflectance R and receiving illuminance I from above will return A·I·R lumens. An automobile driver viewing the horizontal top surface of the marker at an inclination angle of 1° will receive a luminance intensity of only about $$\frac{A(\sin 1°)\cdot I\cdot R}{\pi}.$$

If the marker top surface is a fluorescent material in accordance with the instant invention, rather than a diffusely reflective material of the prior art, then instead of a reflectance R there is a factor F, generally larger than R, such that the luminance intensity is $$\frac{A(\sin 1°)\cdot I\cdot F}{\pi}.$$

In the fluorescent marker of the instant invention, fluorescence is not limited to the top surface, but occurs within the volume of the fluorescent resin material. For the embodiment illustrated in FIG. 1, much of this fluorescent light is trapped within top portion 40. In particular, fluorescent light emitted (⅔°) either upward or downward is trapped, and emitted through the edges. After being emitted through the edges, it will travel 1° either upward or downward. The resulting luminous intensity directed toward the automobile driver is $$\frac{A\cdot I\cdot F}{4\pi}.$$

Importantly, the factor sin(1°) does not appear in this expression. Thus, the front edge 47 of the fluorescent top portion 40 provides a signal that is 1/(4 sin(1°)), or about 14 times as strong as the signal of the same horizontal area of equivalent fluorescent material.

Edge surface 47 can be vertical, or it can be inclined at an angle of up to about ±60° with respect to the vertical. The configuration of edge surface 47, including its angle of tilt with respect to the vertical, can be chosen to maximize the amount of light emitted from edge surface 47 that will be directed back to the driver of an oncoming vehicle. This useful light will be in the angular range of about −3° (down) to about +5° (up). The selection of the angle to maximize the emission of useful light from the edge can depend on factors such as the number and placement of welds between the top portion 40 and the bottom portion 14, and on the color of the bottom portion. Bottom portion 14 can be the same transparent fluorescent orange as top portion 40, or bottom portion 14 can be opaque, such as opaque orange or opaque white. It is believed that opaque bottom portion 14 can be advantageous because a certain percentage of light that passes through top portion 40 will not be reflected by TIR at bottom surface 46, but will pass through bottom surface 46, such as at the weld points where there is no air interface. It is believed that if bottom portion 14 is opaque, a significant amount of this light will be reflected back into top portion 40, and thus have a chance to be "piped" out to edge surface 47. It is currently believed that an embodiment with a fluorescent orange top portion 40, an opaque white bottom portion 14, and an edge surface 47 tilted downward at an angle of about 30° with respect to the vertical might provide a greater amount of useful light emitted through edge surface 47, i.e., a greater amount of light emitted within the approximately −3° to +5° angle so as to be visible to the driver of an oncoming vehicle, than an embodiment having the edge surface 47 vertical.

It is expected that a white opaque bottom portion 14 will provide the additional advantage of reflecting blue and green light and possibly ultraviolet light which passes through the top portion 40 back into top portion 40 for a second chance to excite fluorescence therein.

In those embodiments of the instant invention in which bottom portion 14 is transparent fluorescent orange, longitudinal side walls 16 and 17 also can function as light-piping devices with front-edge glow, in the same manner as top portion 40. This can be done by establishing air interfaces within bottom portion 14 that are approximately parallel to and equidistant from the outer surfaces of longitudinal side walls 16, 17. Daylight striking the outer surfaces of longitudinal side walls 16, 17 can be light-piped to forward facing surfaces 54, 56 of longitudinal side walls 16, 17 disposed laterally adjacent to signal means 24, and will be emitted therefrom to increase the daytime visibility of marker 10. For example, in the illustrated embodiment, but preferably without optional depressions 19, 20, longitudinal side walls 16, 17 can collect in total approximately ⅓ as much daylight as top portion 40, resulting in an increase in total front-edge glow of marker 10 of about ⅓. The amount of light collected by longitudinal side walls 16, 17 and emitted as front-edge glow at surfaces 54, 56 can be optimized, such as by modifications to the configurations of longitudinal side walls 16, 17, and front surfaces 54, 56.

The pavement marker of the instant invention can be made as a one-way marker, in which the marker is intended to provide useful light in only one direction, such as for use on one-way roads; or the marker can be made as a two-way marker, in which the marker is intended to provide useful light in two opposite directions, such as for use on roadways that have two-way traffic. If pavement marker 10 is intended as a two-way marker, then edge surface 48 disposed longitudinally opposite edge surface 47 can be configured to be symmetrical to edge surface 47, assuming that it is desired that the marker have the same illuminating properties in both directions. If the marker 10 is intended as a one-way marker, then edge surface 48 need not have any light-emitting properties. In that case, edge surface 48 can be configured as a saw-tooth edge with a 90° included angle between adjoining faces. This will cause the most useful portion of light that would otherwise be emitted through edge surface 48 to reflect by TIR back toward edge surface 47, thus increasing the brightness of the marker to drivers of oncoming vehicles. Lateral edge surfaces 51 and 53 also can be provided with modified saw-tooth configurations, whether the marker is a one-way marker or a two-way marker, so that light that would otherwise be lost through these lateral edge surfaces can be redirected back into the volume of top portion 40, where it can be subsequently emitted through edge surface 47 as useful light visible to drivers of oncoming vehicles. Metallization of sawtooth edges is also possible.

In some embodiments of the invention, it may be desirable to bond a thin layer of glass or apply an abrasion resistant finish on top surface 43 of top portion 40, to minimize scuffing or abrasion of the top surface 43 that would reduce the TIR that allows the bright signal of the instant invention.

Top portion 40 can serve as a light pipe not only for light incident on top surface 43, but also for light emanating from within the marker, such as from a light emitting diode (LED). Thus an LED situated within the body of bottom portion 14 can be coupled to top portion 40 such that light is directed for emergence either through edge surface 47 or through both edge surfaces 47 and 48, depending on the intended functionality of the marker device.

EXAMPLE

Pavement markers as shown in FIG. 1 were formed of an acrylic resin containing 2% by weight of type ORC-24347-A orange fluorescent colorant available from the Clariant, Masterbatches Division, of McHenry, Ill., with the top portion welded to the bottom portion. The top portion measured about 8.0 cm in the transverse direction, about 6.4 cm in the longitudinal direction, and about 0.35 cm thick. The regular hexagonal weld pattern between the top portion and the bottom portion occupied about 40% of the bottom surface of the top portion. When placed on a roadway surface under moderate winter daylight and spaced at about 60 feet apart, the markers provided good lane guidance to a distance of at least about 300 feet. Unlike nighttime retroreflection, the daytime luminous intensity of the markers did not change with distance. The apparent intensity decreased as a square of the distance from the marker, but the angular closeness of the markers also decreased as a square of the distance from one marker to the next. Thus a very long line of the markers was visible.

Figure 2:
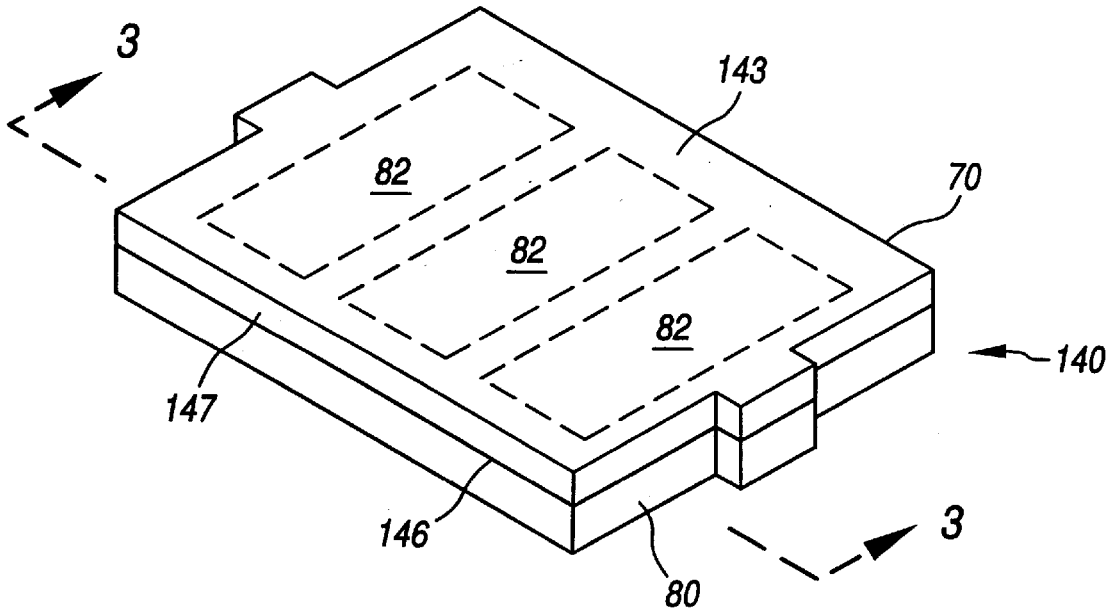
FIG. 2 is a perspective view of a top portion of an alternative embodiment of the instant invention.
Figure 3:
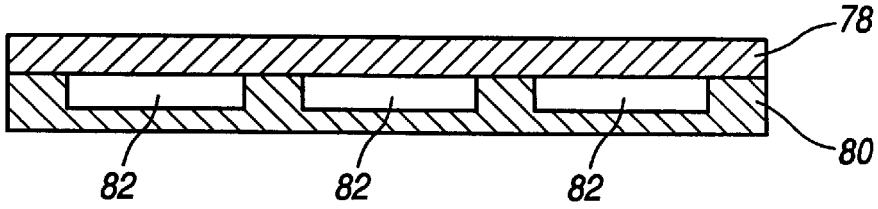
FIG. 3 is a cross-section view along line 3—3 of FIG. 2.

In an alternative embodiment of the instant invention illustrated in FIGS. 2, 3, top portion 140 can be constructed as a two-layer structure with a top light-transmissible fluorescent layer 70 and a bottom layer 80 which can be either transparent fluorescent or opaque. Top layer 70 has a front edge surface 147 at a predetermined angle with respect to the roadway surface, and substantially smooth top surface 143 and bottom surface 146. Top layer 70 and bottom layer 80 are so structured and dimensioned so as to have a plurality of air gaps therebetween when assembled together. For example, bottom layer 80 may have a plurality of grooves or channels 82, shown in phantom lines in FIG. 2 and solid lines in FIG. 3, extending along most of the length thereof and only partially through the depth thereof. Top layer 70 and bottom layer 80 can be assembled together by welding or other known means to form top portion 140. Top portion 140 can then be affixed by epoxy or other known means to a corresponding bottom portion that can carry a retroreflective element, to form a finished roadway marker with improved daytime visibility. In such a construction, the two-layer top portion 140 will serve as a light pipe to direct light incident on top surface 143 to exit top layer 70 through front edge surface 147. As described above, the size edge surfaces of top layer 70 can be provided with saw-tooth edges and/or metallized to facilitate the re-direction of incident light through front edge surface 147.

The embodiments illustrated and described above are those in which the top portion and bottom portion of the base member are formed as two separate parts secured together to form a base member. It will be understood that these embodiments are by way of illustration and not by way of limitation. The invention also encompasses markers in which the top portion and bottom portion are integrally formed together as a base member of a fluorescent resin material.

The pavement marker of the instant invention has been described as being fluorescent orange, which is the color indicative of construction work zones in the United States. Other fluorescent colors can also be used with the inventive pavement markers. For example, fluorescent yellow-green can be used to delineate school zones, or construction zones in other countries. Fluorescent pink or fuschia markers can be used to delineate special traffic lanes, such as electronic pass lanes at toll booths on toll highways.

In another embodiment of the invention the fluorescent portion of the marker, whether just the top portion or just the bottom portion or both, comprises a polymer material which contains in its backbone U.V. light absorbing moieties or moieties which can undergo photo-Fries rearrangement to U.V. light absorbing moieties, thereby providing a fluorescent pavement marker with enhanced fluorescent durability. Suitable polymer materials include polyarylates such as are disclosed, for example, in U.S. Pat. No. 4,598,130 and in Wright et al., *Journal of Membrane Science,* Vol. 124, 1997, pp. 161–174.

In somewhat greater detail, the polymer material suitable for fabricating the fluorescent marker with enhanced fluorescent durability may comprise any polymer in which the polymeric backbone either comprises the repeating ultraviolet light absorbing o-hydroxybenzophenone moiety A, below:

A

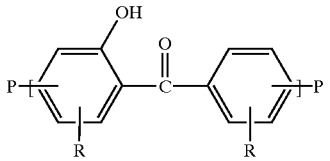

or a repeating moiety capable of undergoing re-arrangement to the above moiety. An example of such a repeating moiety is moiety B below:

B

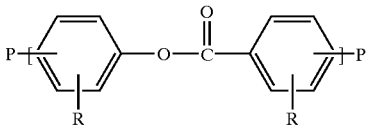

An example of a particularly preferred class of polymers for use in the articles of the present invention containing repeating B moieties (and/or repeating A moieties following photo-Fries rearrangement) are the so-called polyarylates.

Generally speaking, polyarylates are very well known in the art and are obtained by polymerization of a diphenol and a dicarboxylic acid. Polyarylates suitable for use in the articles of the instant invention include those described in U.S. Pat. No. 4,598,130, incorporated herein by reference. As described in U.S. Pat. No. 4,598,130, and for purposes of illustration and not by way of limitation, suitable dihydric phenols that can be employed to prepare the polyarylates are bisphenols such as bis(4-hydroxyphenyl)methane, 2,2-bis(4-hydroxyphenyl)propane (bisphenol-A), 2,2-bis(4-hydroxy-3-methylphenyl)propane, 4,4-bis(4-hydroxyphenyl)heptane, 2,2-bis(4-hydroxy-3,5-dichlorophenyl)propane, 2,2-bis(4-hydroxy-3,5-dibromophenyl)propane, etc.; dihydric phenol ethers such as bis(4-hydroxyphenyl) ether, bis(3,5-dichloro-4-hydroxyphenyl)ether, etc.; dihydroxydiphenyls such as p,p'-dihydroxydiphenyl, 3,3'-dichloro-4,4'-dihydroxydiphenyl, etc.; dihydroxyaryl sulfones such as bis(4-hydroxyphenyl) sulfone, bis(3,5-dimethyl-4-hydroxyphenyl)sulfone, etc.; dihydroxy benzenes, resorcinol, hydroquinone, halo- and alkyl-substituted dihydroxy benzenes such as 1,4-dihydroxy-2,5-dichlorobenzene, 1,4-dihydroxy-3-methylbenzene, etc.; and dihydroxy diphenyl sulfoxides such as bis(4-hydroxyphenyl)sulfoxide, bis(3,5-dibromo-4-hydroxyphenyl)sulfoxide, etc. A variety of additional dihydric phenols are also available such as are disclosed in U.S. Pat. Nos. 2,999,835; 3,028,365 and 3,153,008. Also suitable are copolymers prepared from the above dihydric phenols copolymerized with halogen-containing dihydric phenols such as 2,2-bis(3,5-dichloro-4-hydroxyphenyl)propane, 2,2-bis(3,5-dibromo-4-hydroxyphenyl)propane, etc. It is also possible to employ two or more different dihydric phenols or a copolymer of a dihydric phenol with a glycol or with hydroxy or acid terminated polyester, or with a dibasic acid as well as blends of any of the above materials. Suitable dicarboxylic acids are the aromatic and aliphatic aromatic dicarboxylic acids such as phthalic, isophthalic, terephthalic, o-phthalic, o-, m-, and p-phenylenediacetic acid; the polynuclear aromatic acids such as diphenic acid, and 1,4-naphthalic acid.

One of the most widely used commercial polyarylates results from the polymerization of bisphenol A (2,2-bis-(4-hydroxyphenyl)propane) and a 50:50 mixture iso/terephthalic acids. This polyarylate was previously commercially available under the tradename "Ardel D100" from Amoco Performance Polymers, Inc., and is now sold by Unitika America Corporation and its distributors under the tradename "U-Polymer U-100". The preferred polyarylate used in the present invention has the following formulas I and II below. Formula I is the polyarylate prior to photo-Fries rearrangement. Formula II is the polyarylate following photo-Fries rearrangement. One or both polymers may be present in the articles of the invention:

I

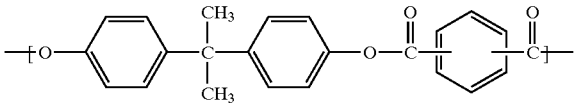

II

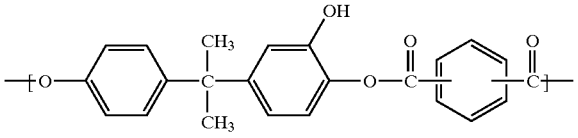

A discussion of the structure and preparation of polyarylates may be found in the chapter entitled "History of Polyarylates" by L. Robeson and J. Tibbet (at page 95 of the treatise *High Performance Polymers: Their Origin and Development,* E. B. Seymour and G. S. Kirshenbaum, editors (1986)). Known processes for the production of a polyarylate include, for example, interfacial polymerization by mixing a solution of an aromatic dicarboxylic acid dihalide in an organic solvent with an alkaline aqueous solution of a bisphenol under stirring to react these materials; solution polymerization by reacting an aromatic dicarboxylic acid dihalide with a bisphenol in the presence of a deacidifying agent such as pyridine in an organic solvent; molten polymerization by reacting an aromatic dicarboxylic acid diphenyl ester with a bisphenol; molten polymerization by reacting an aromatic dicarboxylic acid, diphenyl carbonate and a bisphenol; molten polymerization by reacting an aromatic dicarboxylic acid with a bisphenol diacetate; and polymerization by reacting an aromatic dicarboxylic acid with a bisphenol diacetate. Methods for preparation of polyarylates may be referenced in further detail in Hirose, et al. U.S. Pat. No. 5,034,502 and Berger et al. U.S. Pat. No. 4,374,239, both incorporated herein by reference.

It is well known that, upon exposure to ultraviolet light, polyarylates undergo the photo-Fries rearrangement. See, Korshak et al., in "Synthesis and Properties of Self-Protecting Polyarylates," *Journal of Polymner Science,* Part A-1, Vol. 7, pages 157 to 172 (1969), which describes a mechanism to explain what happens when polyarylates are exposed to U.V. light. The authors propose that polyarylates undergo the photo-Fries rearrangement resulting in carbonyl and hydroxyl groups ortho to one another, structurally similar to o-hydroxybenzophenones which are known light absorbers. The o-hydroxybenzophenones which are part of the polyarylate polymer backbone can absorb greater than 95% U.V. light at wavelengths below 375 nm, and substantial amounts of U.V. light between 375 and 410 nm wavelength light. We have now found that when these moieties are within the polymeric backbone of the fluorescent material, they provide greater durability for those fluorescent colorants than when the benzophenones are present merely as additives to the polymeric resin matrix.

It should be understood that while the above described polyarylate is a preferred U.V. light absorbent polymer for use in articles of the present invention, any polymer which contains moiety A or B, above, is contemplated for use in the invention provided the polymer has properties which make it suitable for use in the particular product application under consideration A further example of such a polymer is the block copolyestercarbonates described in International Patent Application WO 00/26275 (published May 11, 2000), incorporated by reference herein. The copolyestercarbonates described in the '275 application comprise organic carbonate blocks alternating with arylate blocks, where the arylate blocks are derived from a 1,3-dihydroxybenzene moiety and an aromatic dicarboxylic acid. Specifically the block copolyestercarbonate polymer having a moiety A and/or a moiety B as defined above has one or both of the structures (III) and (IV) below, respectively:

(III)

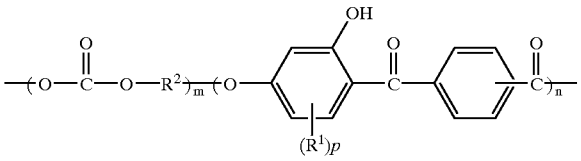

-continued (IV)

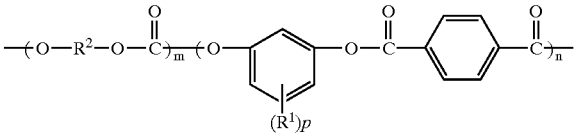

wherein each $R^1$ is independently H or $C_1$–$C_{12}$ alkyl, p is 0–3, each $R^2$ is independently a divalent organic radical; m is at least 1, and preferably about 2–200; and n is at least about 4, and preferably about 30–150.

The applicant in the above mentioned '275 application posits that the weatherability of the above copolyestercarbonates is attributable, at least in part, to the occurrence of thermally or photochemically induced photo-Fries rearrangement of arylate blocks (see structure IV above) to yield o-hydroxybenzophenone moieties (see structure III above) or analogs thereof which serve as absorbers of U.V. radiation.

Additional polymers capable of undergoing rearrangement to U.V. light absorbent polymers are described in Cohen et al in "Transparent Ultraviolet-Barrier Coatings," *Journal of Polymer Science,* Part A-1, Vol. 9, pages 3263 to 3299 (1971) (incorporated by reference) which describes a number of phenyl polyesters, including polyarylates, which were synthesized to furnish molecules whose backbones rearrange under U.V. light to an o-hydroxybenzophenone structure.

The U.V. absorbing properties of the U.V. absorbing polymer need not result from a photo-Fries rearrangement. For example, as explained in the above-mentioned '275 application, synthesis and polymerization of suitable hydroxybenzophenone type monomers can result in polymers in which the U.V. light absorbing moiety A (see above) is already present in the polymer without need for the polymer to undergo photo-Fries rearrangement.

It should be understood that in the case where a polyarylate is used in the present invention, the U.V. light absorbing properties of the polyarylate will take some time to "develop" in the presence of U.V. radiation, with the time for "development" depending upon the environment and the intensity of the U.V. radiation. For example, in a Xenon Arc Weather-O-Meter, polyarylate typically takes about 50 hours to "develop." In view of this "development" period, it may be desired, although not required, to include a small quantity of U.V. light absorbing compounds or light stabilizers in or in front of the fluorescent material to provide some initial protection in the period before the U.V. light absorbing polymer has acquired its fill protective capability.

While the polymeric resin used to fabricate a fluorescent article may consist entirely of the U.V. absorbing polymers described above containing a moiety A and/or B, it is also contemplated herein to use blends of the U.V. absorbing polymer with other suitable polymers that may or may not have a U.V. absorbing moiety in the polymeric backbone. For example, blends of polyarylate with polymers selected from the group consisting of poly(ethylene terephthalate) ("PET"); poly (cyclohexanedimethanol-co-ethylene terephthalate) ("PETG"); polycarbonate; and poly (cyclohexanedimethanol terephthalate) ("PCT") can be used. Reference may be had to Robeson et al. U.S. Pat. Nos. 4,286,075 and 4,259,458 (incorporated herein by reference) for a more detailed discussion of some of the foregoing polyarylate blends. Particularly preferred are blends of polyarylate and either polycarbonate or poly(ethylene terephthalate).

As used in the fluorescent roadway marker of the instant invention, the U.V. light absorbing polymer material can have fluorescent dye blended therein, and the resulting blend can be fabricated into top portion 40 as illustrated in FIG. 1. Alternatively, and as illustrated in FIGS. 2, 3, the U.V. light absorbing polymer material with the fluorescent dye blended therein can be fabricated into top layer 70. In yet another embodiment, the U.V. light absorbing polymer can be fabricated into a separate film or plate which is secured over either fluorescent top portion 40 of FIG. 1 or fluorescent top layer 70 of FIGS. 2, 3, to serve as a U.V. light screening layer for the fluorescent polymeric material below.

What has been described herein is at present what is believed to be the preferred embodiment of the invention, but it is understood that various modifications may be made to the preferred embodiment without departing from the scope of the invention described herein.

What is claimed is:

1. A pavement marker for providing a signal on an associated roadway surface visible to a driver of an oncoming vehicle, said pavement marker comprising a base member, said base member comprising a bottom portion adapted to be mounted to the associated roadway surface, and a top portion comprising a volume, said volume having a front edge surface and top and bottom surfaces, said volume comprising a light transmissible fluorescent resin material, said light transmissible fluorescent material comprising a polymer having in its backbone moieties that either absorb UV light or that are capable of undergoing rearrangement to moieties that absorb UV light, whereby light received by said volume comprising a light-transmissible fluorescent resin material results in light being directed through said volume and emitted through said front edge surface to provide a signal visible to a driver of an oncoming vehicle.

2. The pavement marker of claim 1 wherein said top and bottom portions are configured so as to establish an air gap beneath said volume.

3. The pavement marker of claim 2 wherein said bottom portion is configured with a plurality of orifices adjacent said volume to establish said air gap beneath said volume.

4. The pavement marker of claim 1 wherein said top portion and said bottom portion are separate parts secured together by welding.

5. The pavement marker of claim 1 wherein said volume has flat opposing top and bottom surfaces.

6. The pavement marker of claim 1 further including a retroreflective element.

7. The pavement marker of claim 1 wherein said bottom portion comprises a light-transmissible fluorescent resin material.

8. The pavement marker of claim 7 wherein said bottom portion comprises forward facing surfaces such that light received by said bottom portion results in light being emitted through said forward facing surfaces.

9. The pavement marker of claim 1 wherein said volume comprises an acrylic material.

10. The pavement marker of claim 1 wherein said front edge surface is substantially vertical.

11. The pavement marker of claim 1 wherein said front edge surface is tilted at a predetermined angle.

12. The pavement marker of claim 11 where said front edge surface is tilted downward at an angle of about 30°.

13. The pavement marker of claim 1 wherein said bottom portion comprises an opaque material.

14. The pavement marker of claim 13 wherein said bottom portion comprises an opaque white material.

15. The pavement marker of claim 1 wherein said volume further comprises a rear edge surface disposed longitudinally opposite said front edge surface, such that a portion of the light received by said volume results in light being directed through said volume and emitted through said rear edge surface to provide a signal to a driver of a vehicle approaching the marker from the rear direction.

16. The pavement marker of claim 1 wherein said volume further comprises a rear edge surface disposed longitudinally opposite said front edge surface, said rear edge surface being configured to redirect light toward said front edge surface to be emitted therethrough.

17. The pavement marker of claim 16, wherein said rear edge surface being configured to redirect light toward said front edge surface to be emitted therethrough is a saw-tooth edge surface with substantially 90° included angle between adjoining faces.

18. The pavement marker of claim 17 wherein said rear edge surface is metallized.

19. The pavement marker of claim 1 wherein said volume further comprises one or more side edge surfaces, said one or more side edge surfaces being configured to redirect light to the interior of said volume.

20. The pavement marker of claim 19 wherein said one or more side edge surfaces is configured as a saw-tooth edge surface with substantially 90° included angle between adjoining faces.

21. The pavement marker of claim 20 wherein said one or more side edge surfaces is metallized.

22. The pavement marker of claim 1 wherein said top portion has a top surface provided with an abrasion resistant finish.

23. The pavement marker of claim 1 wherein said top portion has a top surface provided with a glass layer.

24. The pavement marker of claim 1 further comprising an LED disposed in said bottom portion and coupled to said top portion such that light from said LED is emitted through said front edge surface.

25. The pavement marker of claim 1 wherein said bottom portion is provided with depressions on either side thereof and said top portion extends over said depressions, to provide a structure for facilitating holding of said pavement marker.

26. The pavement marker of claim 1 wherein said light-transmissible fluorescent material comprises a polyarylate.

27. The pavement marker of claim 1 wherein said light-transmissible fluorescent material comprises at least one polymeric resin, or mixture thereof, selected from the group consisting of:

(i) polymers having a polymeric backbone comprising the following repeating moiety "A";

A

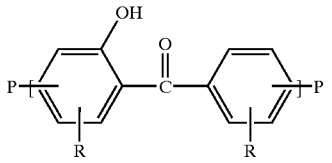

wherein R is a non-interfering substituent and P is the remainder of the polymer; and whereby the polymers are able to absorb ultraviolet light; and (ii) polymers having a polymeric backbone comprising the following repeating moiety B:

B

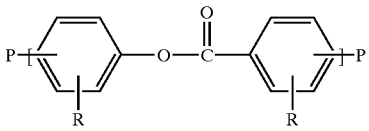

where R is a noninterfering substituent and P is the remainder of the polymer; said moiety B being transformable to said moiety A by photo-Fries rearrangement, whereby said polymer comprising moiety B can be transformed to ultraviolet light absorbing polymer comprising moiety A.

28. The pavement marker of claim 1 wherein said light-transmissible fluorescent material comprises a block copolyestercarbonate having arylate blocks and carbonate blocks.

29. A pavement marker for providing a signal on an associated roadway surface visible to a driver of an oncoming vehicle, said marker comprising a base member, said base member comprising a volume of light-transmissible fluorescent resin material, said volume having top and bottom surfaces and a front edge surface, said light transmissible fluorescent resin material comprising a polymer having in its backbone moieties that either absorb UV light or that are capable of undergoing rearrangement to moieties that absorb UV light, said top and bottom surfaces being configured and arranged such that light received by said top surface results in light being directed through said volume and emitted through said front edge surface to provide a signal to a driver of an oncoming vehicle.

30. The pavement marker of claim 29 being configured to provide an air gap beneath said volume of light-transmissible fluorescent material.

31. The pavement marker of claim 29 wherein said pavement marker has a top surface provided with an abrasion resistant material.

32. The pavement marker of claim 29 wherein said U.V. light absorbing polymer material comprises a polyarylate.

33. The pavement marker of claim 29 wherein said U.V. light absorbing polymer material comprises at least one polymeric resin, or mixture thereof, selected from the group consisting of:

(i) polymers having a polymeric backbone comprising the following repeating moiety A;

A

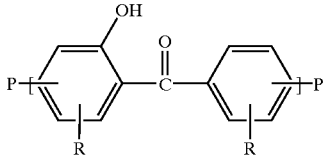

wherein R is a non-interfering substituent and P is the remainder of the polymer; and whereby the polymers are able to absorb ultraviolet light; and (ii) polymers having a polymeric backbone comprising the following repeating moiety B:

B

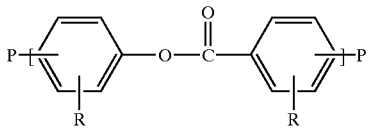

where R is a noninterfering substituent and P is the remainder of the polymer; said moiety B being transformable to said moiety A by photo-Fries rearrangement, whereby said polymer comprising moiety B can be transformed to ultraviolet light absorbing polymer comprising moiety A.

34. The pavement marker of claim 29 wherein said U.V. light absorbing polymer material comprises a block copolyestercarbonate having arylate blocks and carbonate blocks.

35. A pavement marker for providing a signal on an associated roadway surface visible to a driver of an oncoming vehicle, said pavement marker comprising a base member, said base member comprising a bottom portion adapted to be mounted on the roadway surface, and a top portion adapted to be mounted on said bottom portion, said top portion comprising a first layer of a light-transmissible fluorescent resin material and a second layer, said first layer having a light-receiving surface, a front edge surface, and a bottom surface opposite said light receiving surface, said light-transmissible fluorescent resin material comprising a polymer having in its backbone moieties that either absorb UV light or that are capable of undergoing rearrangement to moieties that absorb UV light, whereby light received by said light receiving surface results in light being directed through said first layer and emitted through said front edge surface to provide a signal to a driver of an oncoming vehicle.

36. The pavement marker of claim 35 wherein said top portion is constructed so as to provide an air gap between said first layer and said second layer.

37. The pavement marker of claim 35, wherein said light-transmissible fluorescent material comprises a polyarylate.

38. The pavement marker of claim 35 wherein said light-transmissible fluorescent material comprises at least one polymeric resin, or mixture thereof, selected from the group consisting of:

(i) polymers having a polymeric backbone comprising the following repeating moiety A;

A

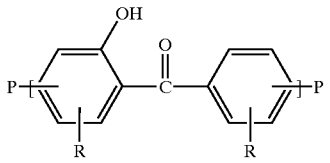

wherein R is a non-interfering substituent and P is the remainder of the polymer; and whereby the polymers are able to absorb ultraviolet light; and (ii) polymers having a polymeric backbone comprising the following repeating moiety B:

B

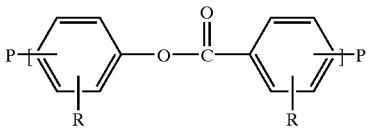

where R is a noninterfering substituent and P is the remainder of the polymer; said moiety B being transformable to said moiety A by photo-Fries rearrangement, whereby said polymer comprising moiety B can be transformed to ultraviolet-absorbing polymer comprising moiety A.

39. The pavement marker of claim 35 wherein said light-transmissible fluorescent material comprises a block copolyestercarbonate having arylate blocks and carbonate blocks.

40. The pavement marker of claim 35 wherein said top portion has a top surface provided with an abrasion resistant material.

41. The pavement marker of claim 35 wherein said bottom portion is provided with depressions on either side thereof and said top portion extends over said depressions, to provide a structure for facilitating holding of said pavement marker.

42. A pavement marker for providing a signal on an associated roadway surface visible to a driver of an oncoming vehicle, said pavement marker comprising a base member, said base member comprising a volume of light-transmissible fluorescent resin material, said volume having a front edge surface and top and bottom surfaces being configured and arranged such that light received by said top surface results in light being directed through said volume and emitted through said front edge surface to provide a signal visible to a driver of an oncoming vehicle, said marker further comprising a U.V. light absorbing polymer material disposed over said light transmissible fluorescent material, said U.V. light absorbing polymer material having in its backbone moieties that either absorb U.V. light or that are capable of undergoing rearrangement to moieties that absorb U.V. light.

43. The pavement marker of claim 42 wherein said U.V. light absorbing polymer material comprises a polyarylate.

44. The pavement marker of claim 42 wherein said U.V. light absorbing polymer material comprises at least one polymeric resin, or mixture thereof, selected from the group consisting of:

(i) polymers having a polymeric backbone comprising the following repeating moiety A;

A

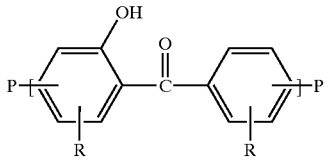

wherein R is a non-interfering substituent and P is the remainder of the polymer; and whereby the polymers are able to absorb ultraviolet light; and (ii) polymers having a polymeric backbone comprising the following repeating moiety B:

B

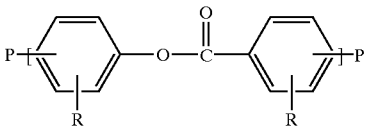

where R is a noninterfering substituent and P is the remainder of the polymer; said moiety B being transformable to said moiety A by photo-Fries rearrangement, whereby said polymer comprising moiety B can be transformed to ultraviolet light absorbing polymer comprising moiety A.

45. The pavement marker of claim 42 wherein said U.V. light absorbing polymer material comprises a block copolyestercarbonate having arylate blocks and carbonate blocks.

* * * * *